US007417203B2

(12) United States Patent
Löfquist et al.

(10) Patent No.: US 7,417,203 B2
(45) Date of Patent: Aug. 26, 2008

(54) METHOD AND DEVICE FOR SORTING OBJECTS

(75) Inventors: Bo Löfquist, Lund (SE); Jesper Pram Nielsen, Hilleröd (SE)

(73) Assignee: Bomill AB, Lund (SE)

( * ) Notice: Subject to any disclaimer, the term of this patent is extended or adjusted under 35 U.S.C. 154(b) by 109 days.

(21) Appl. No.: 10/541,425

(22) PCT Filed: Jan. 5, 2004

(86) PCT No.: PCT/SE2004/000002

§ 371 (c)(1),
(2), (4) Date: Mar. 9, 2006

(87) PCT Pub. No.: WO2004/060585

PCT Pub. Date: Jul. 22, 2004

(65) Prior Publication Data

US 2006/0144762 A1 Jul. 6, 2006

(30) Foreign Application Priority Data

Jan. 3, 2003 (SE) ..... 0300009

(51) Int. Cl.
*B07C 5/00* (2006.01)

(52) U.S. Cl. ..... 209/576; 209/44.2

(58) Field of Classification Search ..... 209/542, 209/576, 577, 587, 588, 590, 44.2, 644, 684, 209/687, 915

See application file for complete search history.

(56) References Cited

U.S. PATENT DOCUMENTS

| | | | | |
|---|---|---|---|---|
| 2,478,246 | A * | 8/1949 | Cortese et al. | 209/627 |
| 4,720,473 | A * | 1/1988 | Welch et al. | 502/21 |
| 4,946,046 | A | 8/1990 | Affleck et al. | |
| 6,096,991 | A | 8/2000 | Stone et al. | |
| 6,497,324 | B1 * | 12/2002 | Doak et al. | 209/522 |
| 7,173,709 | B2 * | 2/2007 | Doak et al. | 356/446 |

FOREIGN PATENT DOCUMENTS

| | | |
|---|---|---|
| FR | 1400254 | 4/1965 |
| GB | 2 273 154 A | 6/1994 |

* cited by examiner

*Primary Examiner*—Joseph C Rodriguez
(74) *Attorney, Agent, or Firm*—Merchant & Gould P.C.

(57) ABSTRACT

A sorting device to sort granules within a bulk of granules, where the granules differ in quality includes a positioning means giving a well-separated position for each granule. At least one detector is arranged to receive electromagnetic radiation or sonic waves sent by an energy source via the granules. Furthermore, ejecting means are arranged to eject the granules into receiving means based on the detected quality.

12 Claims, 7 Drawing Sheets

METHOD AND DEVICE FOR SORTING OBJECTS

TECHNICAL FIELD

The present invention concerns sorting devices and methods to sort objects within a bulk of objects, where the objects differ in quality.

The sorting device is developed for use with methods of sorting objects within a heterogeneous population by removal from the sorting device at least one collected fraction of different quality of composition with reference to one or more specific characteristics measured on each single objects. The invention is developed for industrial use, i.e. it should be possible to handle large quantities of single objects at a high rate.

PRIOR ART

There exist a number of methods for coarse sorting or removing (cleaning) objects according to length, size and density.

For example, in the cleaning of grains it is common to use machines designed to screen out over- and undersized material or to classify for example malting barley according to the width of the kernels. Further gravity tables are used for coarse sorting of granular materials according to the density of the granules. However, to function well there should be a substantial difference in density between the different fractions.

It is known to sort grains by means of a rotating cylinder or drum, which cylinder has pockets on the inside. This indented cylinder is rotating (axis horizontal) and granules are feed into one end of the cylinder, and as the cylinder rotates the granules will be lifted in that they are captured in the pockets. The pockets are given a design by which ideally one single granule is to be received in each pocket. As the cylinder rotates the granules fall out of the pockets at different positions due to the gravity. A trough is placed inside the cylinder to be able to separate the granules falling at a late position. Long granules have a point of gravity in the upper part of the pockets and fall out earlier than shorter granules, which fit in deeper into the pockets. The granules not captured in the trough leaves the cylinder as an overflow. By this device it is normally not possible to sort the granules into more than two groups, if further separation is wanted further cylinders may be placed after the first cylinder. Furthermore, the sorting is only done depending on length and/or shape. The single granules are not passed before a detector.

There are also machines, which sort/clean granular materials according to their colour. In these machines the material to be sorted/cleaned is made to fall into the free atmosphere, ideally one by one. During their fall the granules are illuminated with light. The reflected light from each granule is detected at 1-3 pre-selected bands of wavelength in the visible and/or infrared (IR) range by use of e.g. optical filters. These bands are pre-selected in order to give a signal corresponding to a known and desired sorting/cleaning characteristic of the granules. Furthermore, in these methods the optical filters are selected so that there is a substantial difference in the fraction of reflected light from a wanted versus an unwanted granule, which light will reach sensors through the filters. If a granule having unwanted characteristics is detected it will be blown to one side during the continued free fall.

One problem with colour sorters is that several granules surrounding the detected, unwanted granule will be blown to the one side together with the detected granule. Thus, the rejected granules will include a high percentage of granules that should not have been rejected. The colour sorter is only used to clean out not suitable granules present in low percentages such as impurities and discoloured or defect granules etc. and it is used as a cleaning device and not used to sort granules into several different fractions of more specific characteristics.

In practice the known devices often only function as a cleaning device, i.e. removing impurities, defect objects etc.

THE INVENTION

To simplify, the expression "granule" is used in this description as a general term, thus, "granule" should be interpreted broadly and also covering other types of products suitable for sorting, such as plastic parts, beads, pills, grains, beans etc. The expression "object" is used in this description interchangeable with "granule", and thus should also be interpreted broadly. A person skilled in the art realizes that the exact type and form of the granules, objects etc. to be sorted are of no importance for the invention as such.

The sorting device could be divided into three main parts or rather functions that it should fulfil. These parts are a positioning means, a detecting means and an ejecting and collecting means. Furthermore, some source or sources of radiation or sonic waves are provided for cooperation with the detecting means. Each granule should first be positioned separately and in a well-defined or at least well-separated position for passing a detecting means. Depending on the result of the detection the ejecting means will eject each granule into desired and preselected subgroups matching the detected quality or qualities. In order to be able to fulfill the above functions in a proper way some kind of control means is arranged.

The specific qualities or characteristics to be sorted for may be a variation in chemical composition or internal structure, a derived property like wetability, flavour, thermal plasticity, millability or a potential of a certain class of the objects to cause good baking quality after processing of the seeds into flour, a large volume of popcorn after popping, a better malt quality after malting, a particular strength of a plastic object, pharamaceutical pills having no tendency to burst, a less bitter taste of chocolate after processing of cocoa beans, an improved quality of coffee beans, soy beans etc. It is also possible to sort based on the form, density, colour, etc.

The device of the present invention is to be used for sorting of objects from a heterogeneous population. It provides real time ultra fast steps of: energy exposure, recording of a signal (s) of reflected, transmitted or emitted energy, preprocessing if needed of the recorded signal(s), classifying and/or predicting of a signal for ejection of each of the objects or use of the recorded signal directly for ejection. Image analysis, radiation analysis, spectroscopic analysis, sonic wave analysis etc. may be used in connection with the sorting device of the present invention. Thus, CCD-cameras, detectors for emitted, transmitted and/or reflected light or radiation, both for multivariate and univariate detection etc. may be used for detection of the specific characteristics to be sorted for. To simplify we use the expression "detecting means" in this description, which expression should be construed to cover any suitable detector or a combination of detectors of the quality including possible recording and processing equipment, e.g. the above detectors. Any electromagnetic radiation or sonic waves, alone or in combination, can be used, such as x-rays, ultraviolet light, visual light, near infrared light, infrared light, fluorescent light, ultrasonic waves, microwaves, or nuclear magnetic fields. The source of electromagnetic radiation may be a light emitting diode, a lamp, a stroboscope etc. The expression "detecting means" as used in this description also includes the source of electromagnetic radiation and possible fiber optic cables, lenses, filters etc.

One object of the present invention is to arrange the single granules in a bulk of granules in such a way that they can be measured and ejected one by one.

A further object of the present invention is to be able to divide the granules etc. into at least two subgroups due to one or more specific qualities.

A further object of the present invention is that it shall be possible to sort a large quantity of granules or objects at a relatively high speed. The invention is developed for use in production lines.

The sorting device is further developed to be able to sort each single granule (object) or the like independently into subgroups having similar quality regarding one or more specific characteristics important for the end results of the production chains, where the granules are to be used.

According to one aspect of the present invention a drum having pockets on the inside is used. The drum is rotated with such a high speed that the granules will be caught and held in the pockets by means of gravity and the centrifugal force, for a time period sufficiently long to allow for detection of quality and appropriate ejection. The pockets are placed to pass the detecting means by which the quality of the single granules is recorded. The granules belonging to at least one subgroup is then ejected by force to a receiving means normally placed inside the drum. At least one receiving means is placed inside the drum and the granules matching the detected specific characteristics are ejected into the receiving means.

The granules are separated in such a way that they are led one by one past the detecting means and following that to the ejectors. Thus, there is a distance between the single granules during the detection and ejection steps.

The previously known devices often has a more or less passive ejection, e.g. the objects fall out of pockets due to size. In the present invention the ejection of at least one subgroup is active, i.e. the ejection is done by an active action.

Further objects and advantages with the present invention will be obvious for a person skilled in the art when reading the detailed description below of at present preferred embodiments.

BRIEF DESCRIPTION OF THE DRAWINGS

The invention will be described more closely below with reference to preferred embodiments, by way of example, and with reference to the drawings below. In the drawings.

DETAILED DESCRIPTION OF THE PREFERRED EMBODIMENTS

Figure 1:
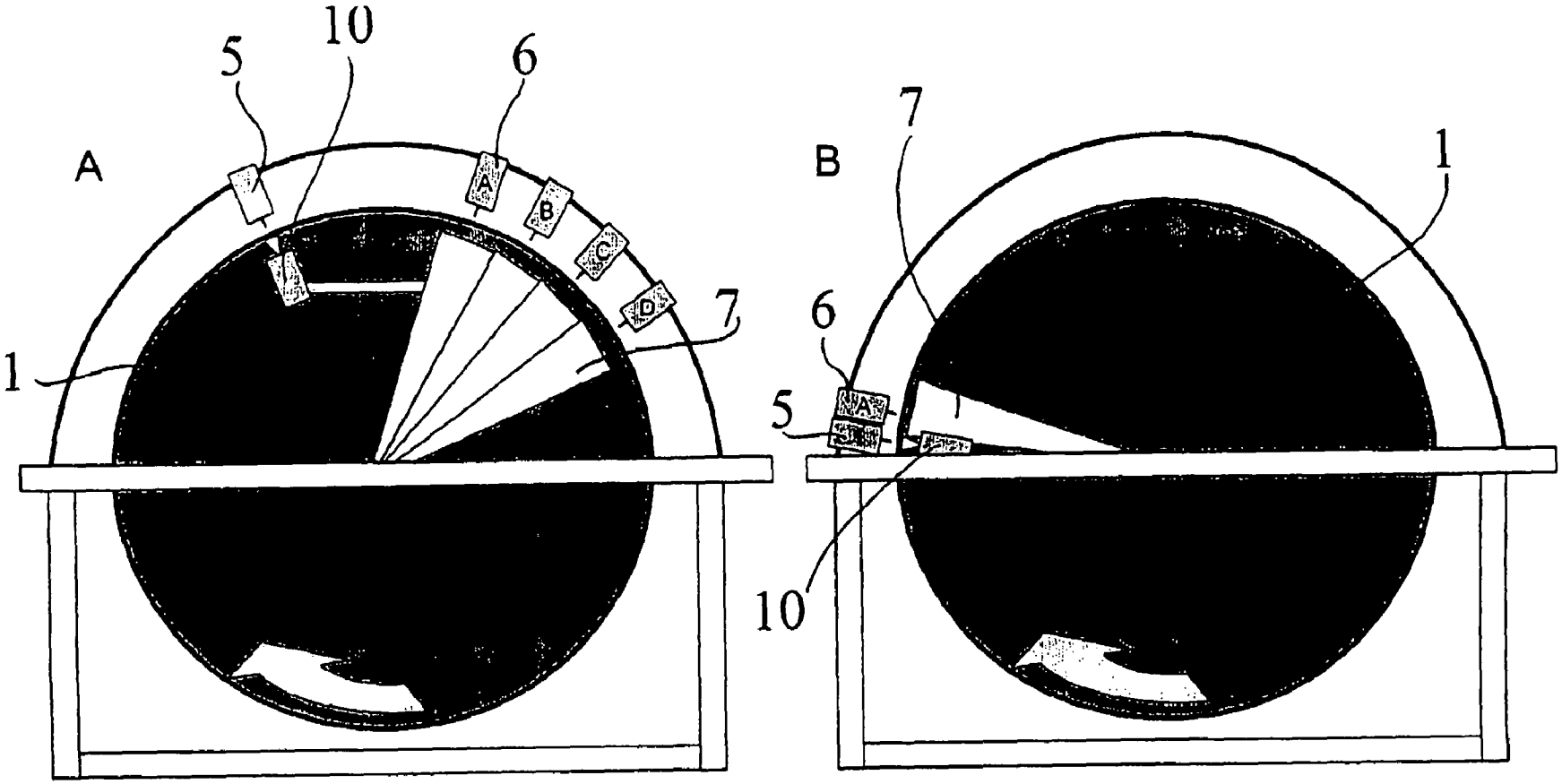
FIG. 1A is an end sectional view of an example of a sorting device according to the present invention.
FIG. 1B is an end sectional view of yet an example of a sorting device according to the present invention.
Figure 2:
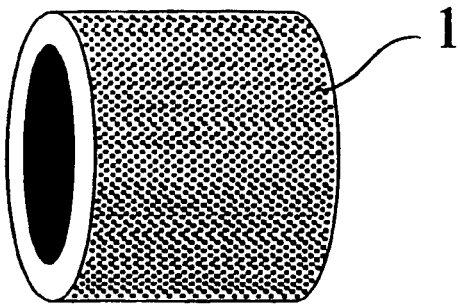
FIG. 2 is a perspective view of a part of the sorting device of FIG. 1.

The apparatus of the present invention comprises a drum or cylinder 1 in which the granules 9 to be sorted are received. The cylinder 1 may have any orientation in use, i.e. the rotational axis may be vertical, horizontal or show any angle between vertical and horizontal. The inside 2 of the cylinder is furnished with a large number of pockets 3. In the shown embodiment the pockets 3 have a rounded form both in a vertical and a horizontal plane. In other embodiments the pockets 3 have other shapes, depending on the form of the objects or granules 9 to be sorted. In one embodiment the pockets have a flat bottom. One granule 9 is to be received inside every pocket 3. The form of the pockets 3 is adapted to the granules 9 to be sorted. For different types of granules 9 differently shaped pockets 3 will function best. It is also possible to have a pre-sorting of the granules 9 according to size and shape to be able to have a more precise design of the pockets 3. The pockets 3 should have at least a depth that is enough to securely capture and hold one granule 9.

The cylinder 1 is received in some kind of stand 11 as indicated in FIG. 1. However, as the exact form of the stand 11 is of no importance for the present invention it will not be discussed further here.

In the embodiment indicated in FIG. 1A the cylinder 1 is rotated with at least such a high speed that the granules 9 will be held in the pockets 3 by means of the centrifugal force also at the top of the turn of the cylinder 1. However, the cylinder 1 should not be rotated with a too high speed, as that may lead to a higher risk of overfilling, e.g. more than one granule 9 in each pocket, and that it may be more difficult to get a proper ejection. In practice it has become apparent that also a speed just under the speed holding the granules 9 by means of the centrifugal force functions. The reason for this is probably that the speed is still high enough to hinder a granule 9 at the top of the turn to fall by means of gravity. The side of the pocket 3 catches the granule 9 before it has fallen too far.

In the embodiment of FIG. 1B the speed of the cylinder 1 may be considerably lower than in the previous embodiment (FIG. 1A). It is enough that the granules 9 are kept in the pockets 3 for as long time as it takes to pass the detection and ejection means. The granules 9 not ejected from the pockets 3 will fall by gravity when approaching the top of the turn of the cylinder 1. The granules 9 falling by gravity are either caught in receiving means or are fed back to a "cushion" of granules 9 at the bottom of the cylinder 1.

Irrespectively of the speed of the cylinder 1, it should be rotated with such a speed that the granules 9 will be held in the pockets 3 by means of gravity and centrifugal force for a time long enough to perform measurements and ejection of at least one fraction. The speed of the cylinder 1 has to be adjusted to match the diameter of the cylinder 1, the design of the pockets 3, its filling and the function of the ejecting and receiving means etc. Different speeds may be used for different embodiments as well as for different batches and types of objects. The granules 9 are normally fed into the bottom of the cylinder 1, and a "cushion" of granules 9 will be held at the bottom and secures that not more than one single granule 9 is picked up and held in each pocket 3 on the inside 2 of the cylinder 1.

The pockets 3 are normally placed in a number of rows inside the cylinder 1, with only a short distance between adjacent rows of pockets 3. Also the pockets 3 of each row are normally placed at a short distance from each other. In some embodiments the distance between the separate pockets is relatively large. Each row of pockets 3 is extended in the circumferential direction of the cylinder 1. The number of rows varies but is often between 20 and 200. However, the number of rows is of no importance for the principals of this invention. The number of rows and the number of pockets 3 per row are dictated by a number of factors such as the size, quantity and filling performance of objects 9 to be sorted, the number of detectors, energy sources and ejecting means used, available space, desired capacity etc.

The cylinder 1 functions as a positioning means used to present the objects 9 in separated and possibly well-defined positions. A person skilled in the art realizes that any apparatus capable of this at a high speed may be used as positioning means. Thus, as used in this description the term "positioning means" covers any such apparatus.

In alternative embodiments (not shown) concentric rings with pockets and/or rings/discs forming concentric rows are used as positioning means.

In the bottom of each pocket 3 an opening 4 is normally provided. The bottom of each pocket 3 is formed in order for the granules 9 to be placed securely over the openings 4. Due to the design of the bottom and the centrifugal force induced by the high rotating speed of the cylinder 1 each granule 9 will take the desired position covering the opening 4. Furthermore, the center of gravity of each granule 9 is normally such that the granules 9 are oriented in a similar fashion in the pockets 3, if the center of gravity is not equal to the geometric center.

Both at least one detecting means (sensor, detector 5) with related at least one energy source 10 and at least one ejector 6 are connected to each row of pockets 3 in position to normally be able to communicate with the opening 4 of each pocket 3. The opening 4 of each pocket 3 may be elongated to give an extended detection and/or ejection area/period. The distance between detecting means and ejector(s) 6 is such that the detection and subsequent calculation if any is completed when the granule 9 is in position for ejection.

Figure 6:
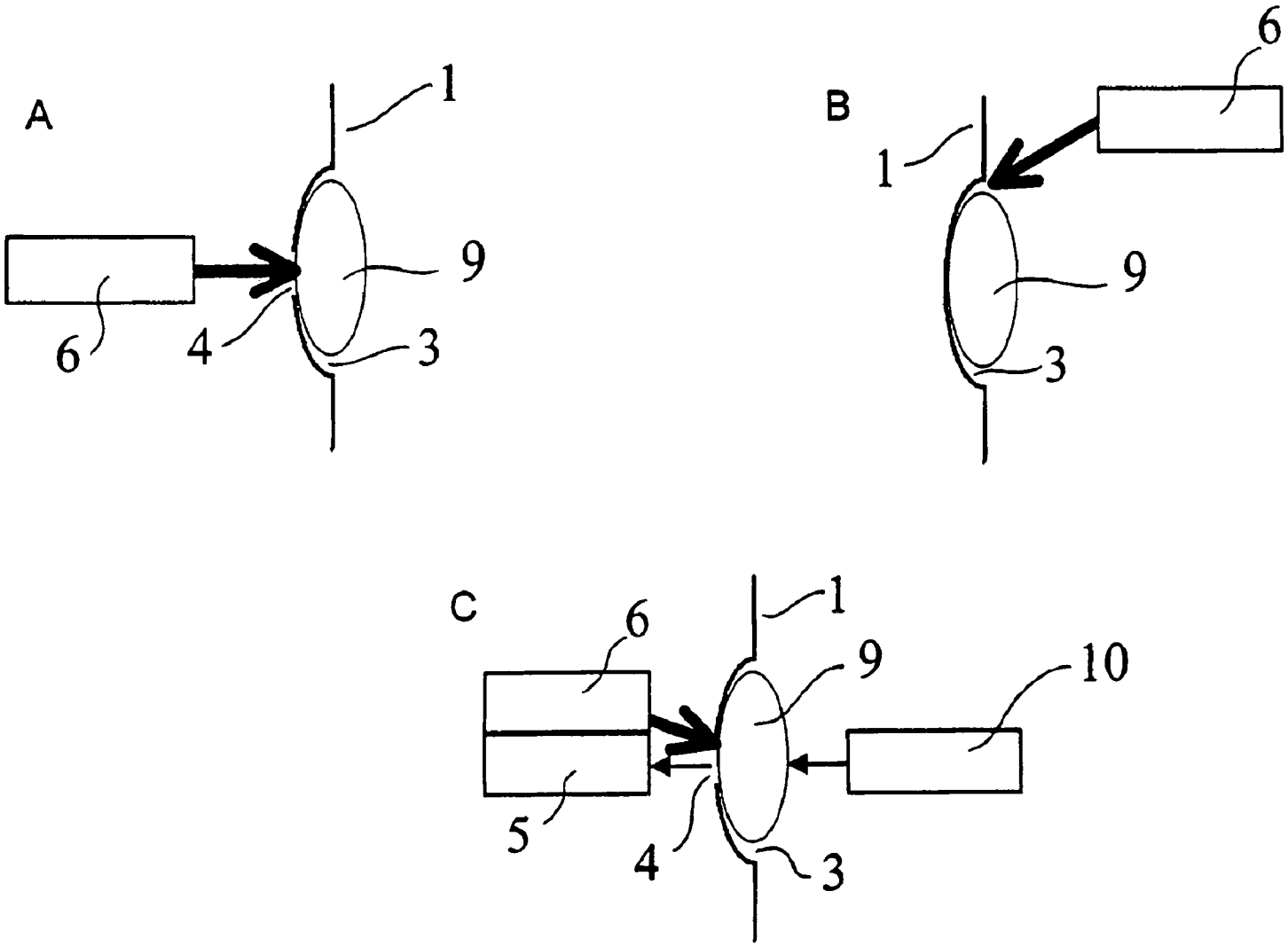
FIG. 6 is a view exemplifying different placing of the ejectors and the detecting means (FIG. 6C)

In some embodiments at least one detecting means is placed in close proximity to each ejector 6. (See FIG. 6C) In such a case the detection and ejection is made almost simultaneously, i.e. during the period of time the opening 4 of a pocket 3 passes the detecting means and ejector 6 being in close proximity. Often the output of the detecting means is directly fed to the ejecting means, and if the output is within a certain pre-determined range the ejecting means will eject the granule 9. Thus, one can say that the detection and ejection in practice is done in one and the same point or position.

In order for the granules 9 to have a sufficiently well-separated position during detection and ejection a timer is often used. By means of the timer the exact position of each pocket 3 is established and correlated (synchronized) to the positions of the detecting means and the ejecting means 6. In stead of using the time to control the position of each pocket 3 during detection and ejection, in another embodiment one presumes that there is a sufficiently exact distance between adjacent pockets 3. In the latter case the position of the pockets 3 in relation to the detecting means and ejecting means 6 may be checked regularly, e.g. at least once every turn of the cylinder 1 or at fixed time or turning intervals. It is not necessary, but sometimes recommended, to have any timer for that case where each detecting means 5 and ejector 6 are placed in close proximity. As the detection and ejection is done in approximately the same point a less complicated system may be used.

In one embodiment one detecting means is arranged to take care of several rows, by means of fiber optic cables 12 or the like. To give a larger measuring area a lens may be placed at the end of each fiber optic cable 12. A person skilled in the art realizes that the principals of the invention are the same, whether only a detector 5 alone or a detector 5 combined with fiber optic cables 12 and possible lenses, filters etc. are used. The pockets 3 in adjacent rows may be displaced somewhat so that the detecting means will be able to operate on one row at the time. At least one energy source 10 is provided in the detecting means to expose the objects 9 in the pockets 3 to emitted energy. The energy emitted may be electromagnetic radiation and/or sonic waves, distributed continuously or intermittently directly to the object(s) or via fiber optic cables, lenses, diffusers, filters etc. The energy source(s) emits energy, which by reflection, transmission or emission from the objects are received by the detector(s) 5. In an alternative embodiment (not shown) at least one photocell with or without filters are used as detecting means. Depending on the magnitude of the recorded signal, often in view of a reference signal, the proper ejection means is activated to eject the object 9 into the proper receiving means 7.

A reference signal may be taken up by a parallel detecting means receiving the signal directly, thus without having passed the object, i.e. not being emitted, transmitted or being reflected on an object 9. In order for the further photocell to receive the reference signal the cylinder 1 may be furnished with openings or reflectors. The positions of these openings or reflectors are correlated to the positions of the detecting means and pockets 3 during detection.

Figure 4:
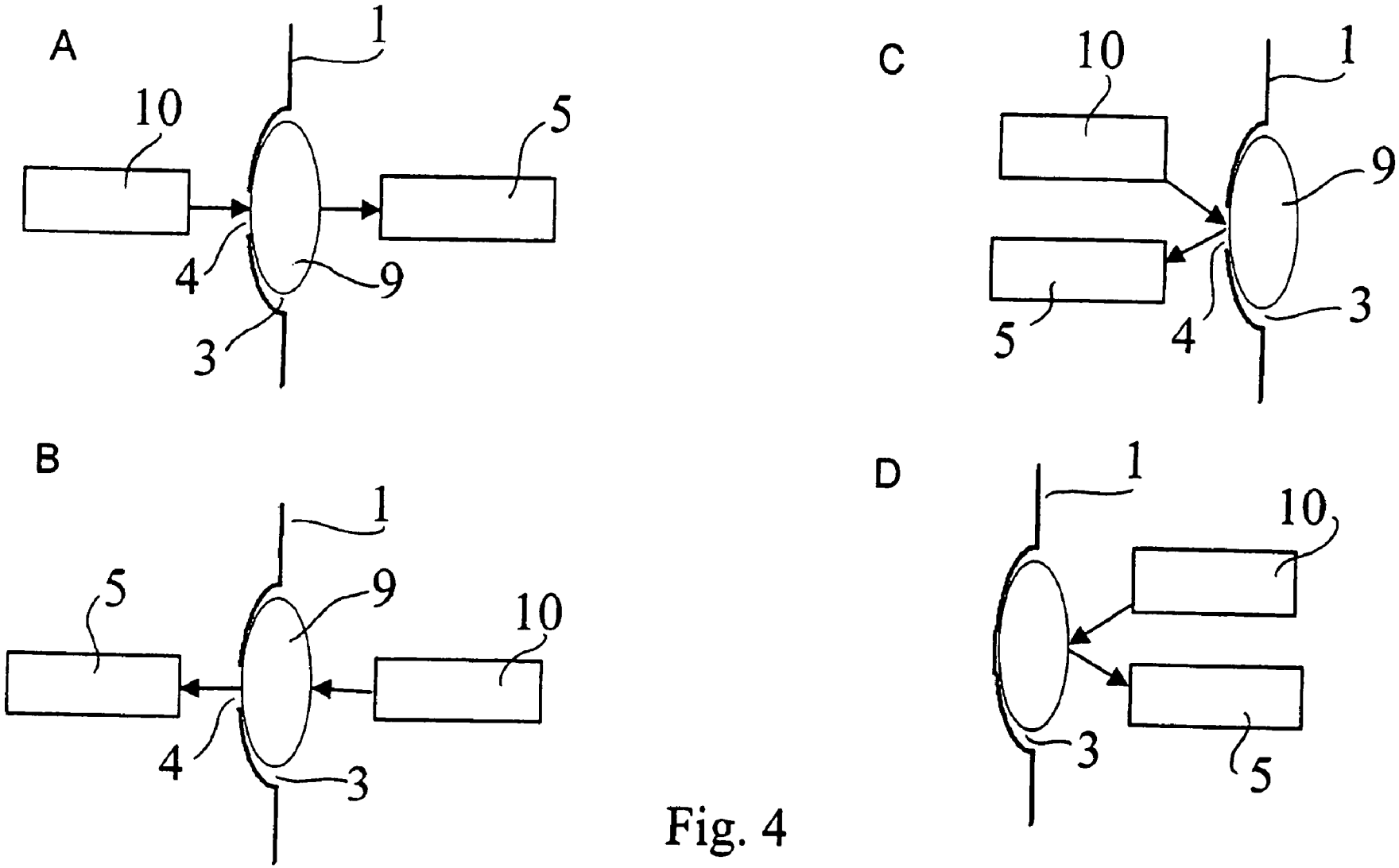
FIG. 4 is a view exemplifying different placing of the detectors and co-operating energy sources.
Figure 5:
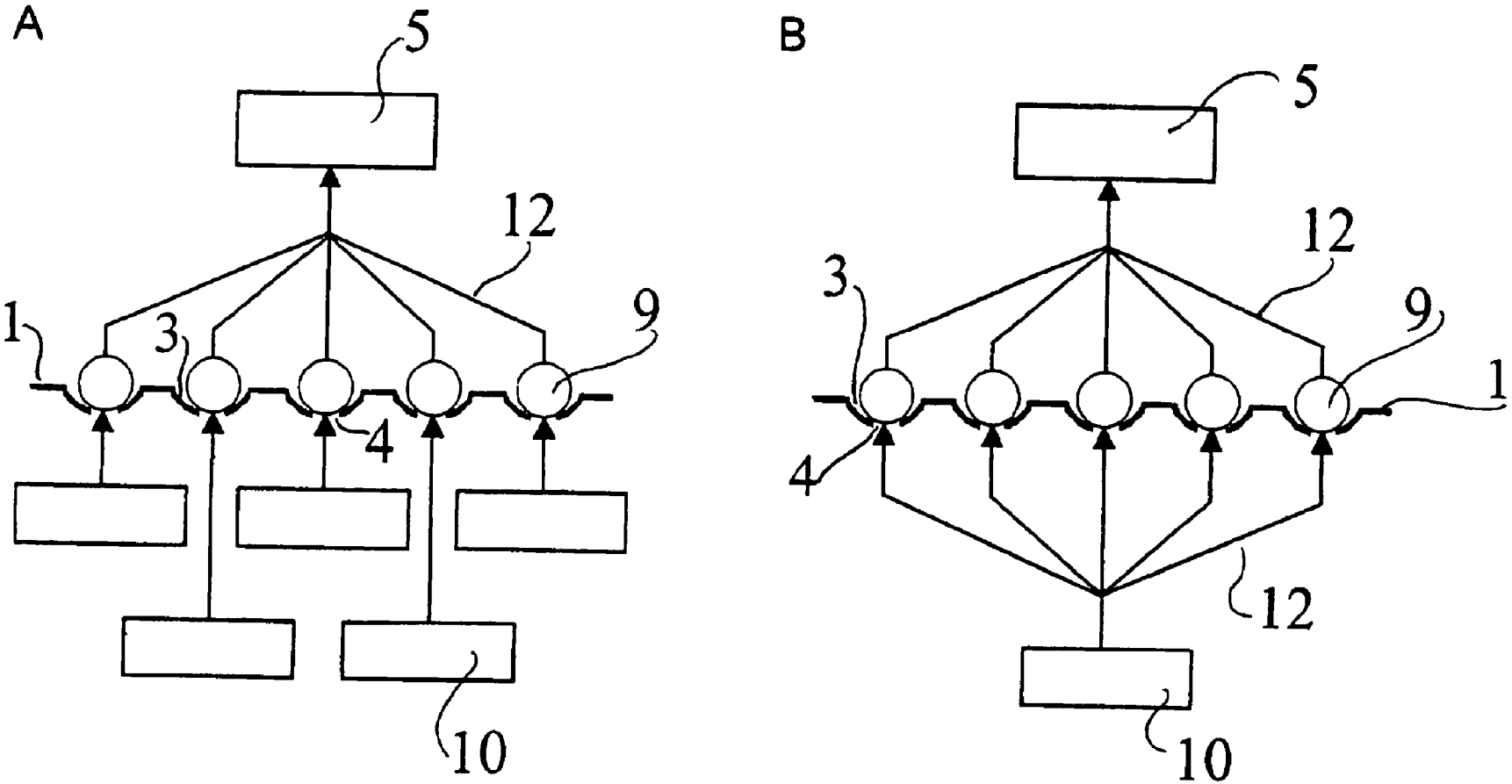
FIG. 5 is a view exemplifying different arrangements for the detectors and co-operating energy sources.

As indicated in FIGS. 4 and 5 the detectors 5 and cooperating energy sources 10 of the detecting means may be placed in different positions and may each cover several rows of pockets 3. The detectors 5 and energy sources 10 may be placed on the same side or on opposite sides of the object 9 in the pocket 3. Furthermore, both each detector 5 and each energy source 10 may be utilized for one or several rows of pockets 3, e.g. by means of fiber optic cables 12. If both the detector 5 and the energy source 10 are placed on the same side of the pocket 3, the pockets 3 may not have any opening (see FIG. 4D). However, an opening 4 may be needed for the ejection means.

The ejecting means 6 will in one embodiment give a short air pulse to blow each granule 9 directly or through an air pipe into a proper receiving device 7. A suitable source of compressed air (not shown) is connected to the ejecting means 6, by means of at least one valve. The valve may be single way or multi way. By means of the multi way valve the air pulse of the air source may be led to several ejectors 6, thus ejecting several objects 9 simultaneously. The valve is opened when the ejecting means 6 is to eject an object. Sometimes the last ejecting means 6, i.e. the ejecting means 6 placed furthest from the detecting means, is constantly blowing air. A person skilled in the art realizes that any type of ejecting means may be used. In one embodiment the ejecting means 6 operates at a frequency of 150-250 Hz (pulses/second). If the frequency of the ejecting means is too low to have enough time for the appropriate number of ejections, two ejecting means 6 may be arranged operating alternately. The ejecting means 6 are normally placed outside the cylinder 1. However, in some embodiments the ejecting means 6 may be placed on the inside, pointing directly or at an angle to the pockets 3 (see FIG. 6B). In the latter case the pockets 3 may be closed, if not the detecting means require an opening 4 at the bottom of the pocket 3.

As used in this description the term "ejecting means" covers any type of ejecting means capable of ejecting the granules or objects at the proper position. The term "ejector" is mainly used in this description for a nozzle, jet, tube, pipe etc. used for directing an air pulse towards the objects.

An appropriate number of ejecting means 6 are placed in connection with each row of pockets 3. At least one ejecting means 6 is placed in connection with each receiving device 7 in a position to be able to eject a granule 9 into that receiving device 7. Put in other words at least one ejecting means 6 is arranged for each subgroup. Often the last ejecting means 6 has no valve and is open all the time, thus giving a constant airflow. In this way the pockets 3 are always emptied. In some embodiments it is enough that the ejecting means 6 just force the granules 9 out of the separate pockets 3. The granules will then fall by means of gravity into the proper receiving device 7. In such a case the positions of the ejecting means 6 have to be adapted to the positions of the receiving devices 7.

In other embodiments the last subgroup is collected or fed back to the cushion without use of any ejecting means, i.e. it falls out by means of gravity. The gravity force being larger than the centrifugal force.

As stated above the detectors 5 and energy sources 10 of the detecting means and the ejecting means 6 are placed either on the inside or the outside of the cylinder 1.

In connection with the ejecting means 6 at least one receiving device 7 is placed. The receiving devices 7 are normally placed inside the cylinder 1. The receiving devices 7 are to receive the sorted granules 9 and lead them to a receptacle (container) 8. The number of receiving devices 7 and receptacles 8 used are due to the number of fractions or subgroups that are to be produced. There may also be receptacles 8 for granules 9 having qualities above and under, respectively the useful intervals.

In one embodiment the receiving devices 7 are troughs 13 placed inside the cylinder 1. One trough 13 is arranged to receive the ejected separate sorted fraction. The granules 9 are led from the troughs 13 in a suitable way, e.g. by gravity or by means of a conveyor screw placed in the bottom of each trough 13 etc. Any suitable receiving devices 7 may be used such as tubes leading to receptacles 8 etc.

In a further embodiment (not shown), the granules 9 are released directly to the outside of the cylinder 1 from the pockets 3. This is done in that the bottom of each pocket 3 has the form of an openable flap or the like. If several concentric rings are used as positioning means the ejection may be arranged in that two adjacent rings move slightly away from each other, releasing the proper object. In a further alternative the granules 9 are ejected from the pockets 3 by means of mechanical ejectors, e.g. rods operated e.g. by electromagnets. The rods or other mechanical ejectors are small enough to go through the openings 4 of the pockets 3 or are installed on the inside of the cylinder 1.

The detectors 5, ejectors 6, energy sources 10 and/or receiving means 7 are often controlled by some kind of controlling device. The controlling device is adapted to the type of detecting means, ejecting means and energy sources used and the type of objects and to the sorting to be performed.

Figure 7:
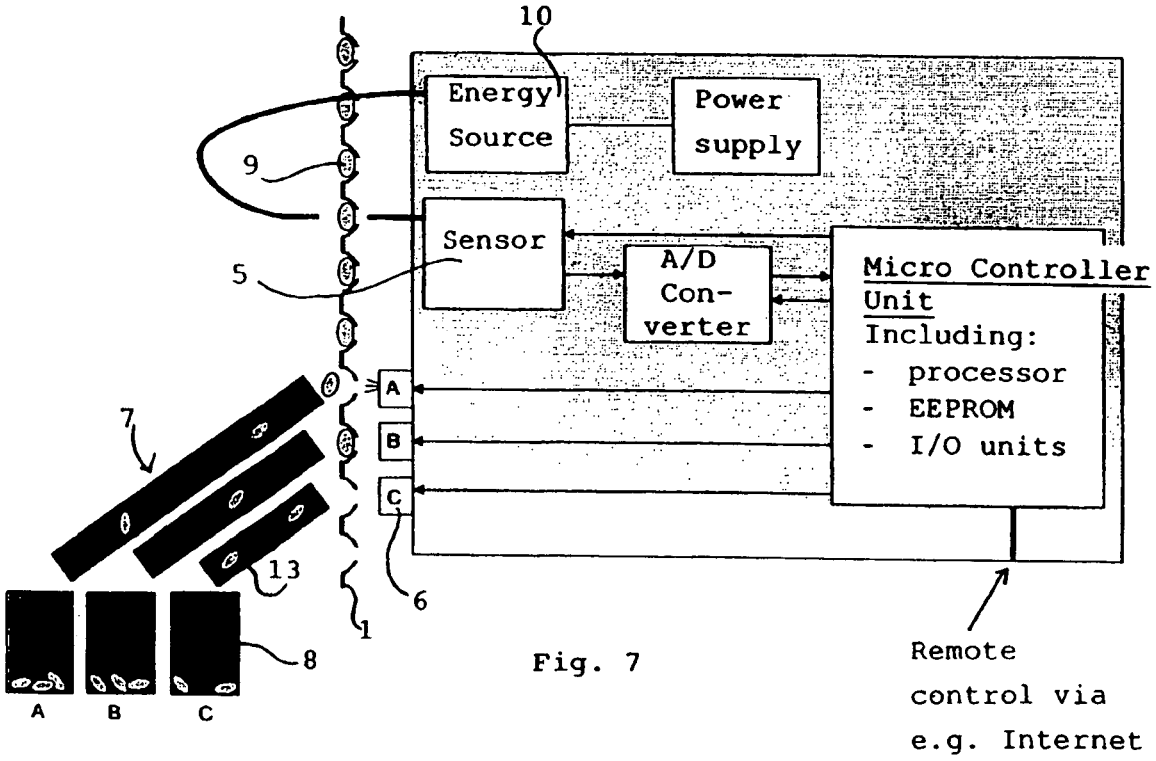
FIG. 7 is a principal view of one way to operate a sorting device according to the present invention.
Figure 3:
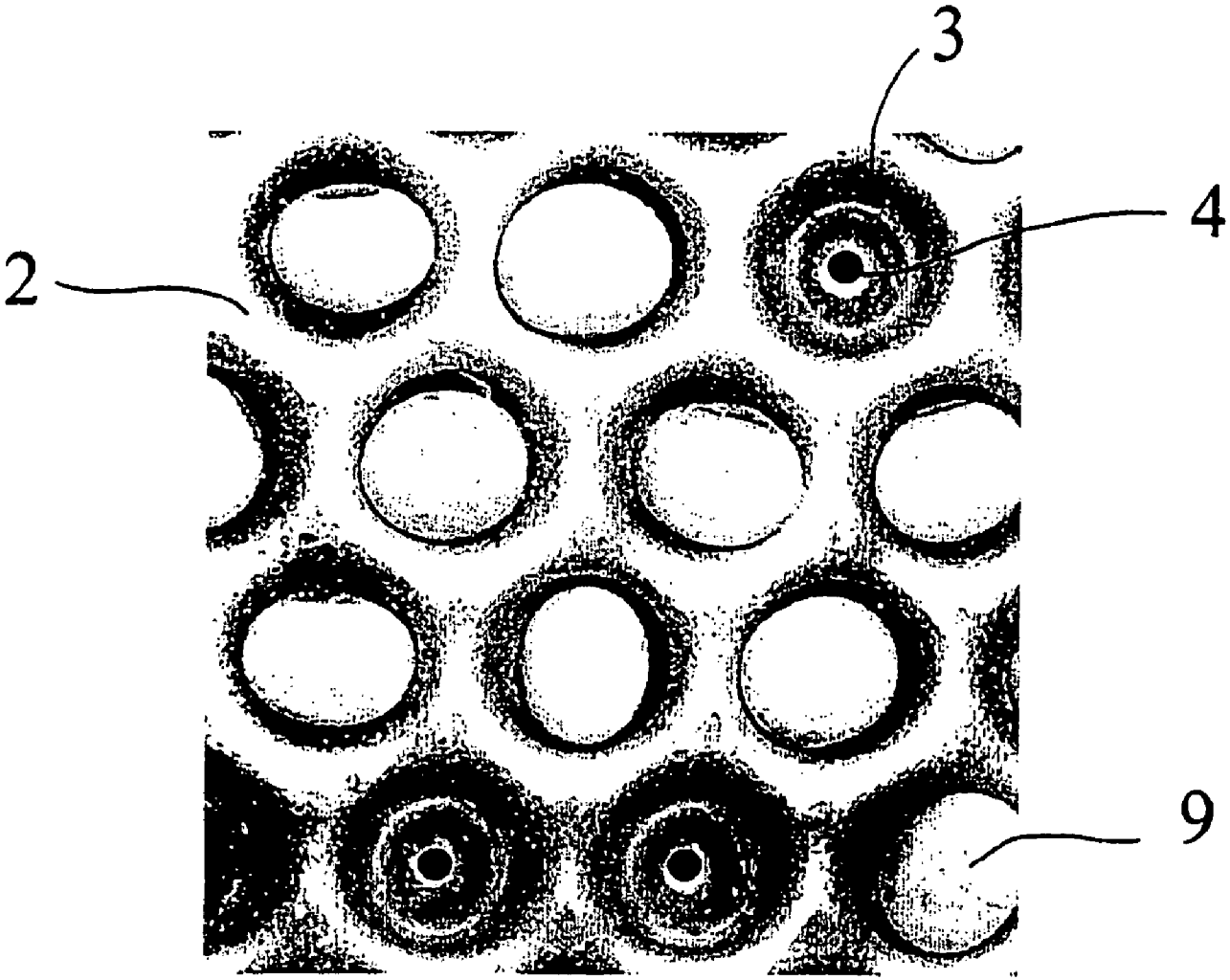
FIG. 3 is a detail view of a part of the sorting device of FIG. 1.

In the exemplified embodiment of FIG. 7 a micro controller unit (MCU) is used to control the detecting means and ejecting means. An A/D converter is arranged to convert the recorded signal from the detecting means from an analogue to a digital signal. The digital signal enters the MCU. In the MCU, the recorded signal may be transformed by means of a supervised or an unsupervised pre-treatment. The pre-treated signal is by means of a calibration model previously performed converted into a ejector signal expressing the magnitude of the specific quality(ies) to be sorted for. The recorded signal can be multivariate or univariate in its nature. The magnitude of the ejector signal is used for classification of the objects into different subgroups. The calibration model is stored on an EEPROM included in the MCU. Different calibrations are used for different types of objects and/or different specific characteristics to be sorted for. The same MCU may be used, but with adapted software. In one embodiment the adaptation of the software is done remotely, e.g. via the internet, an intranet etc.

The number of subgroups and the magnitude range of the ejector signal in each of the subgroups are set before sorting. Assume that one want to sort into three subgroups (A, B and C) as exemplified in FIG. 7. Then when the ejector signal is within the limits of subgroup A, a signal is sent from the MCU to activate the corresponding ejecting means 6, and when the ejector signal is within the limit of subgroup B, a signal is sent from the MCU to activate the corresponding ejecting means 6 and so on.

The sorting process is in the exemplified embodiment controlled by the processor in the MCU according to the timing logic and when applicable adequate timing signal(s).

Figure 8:
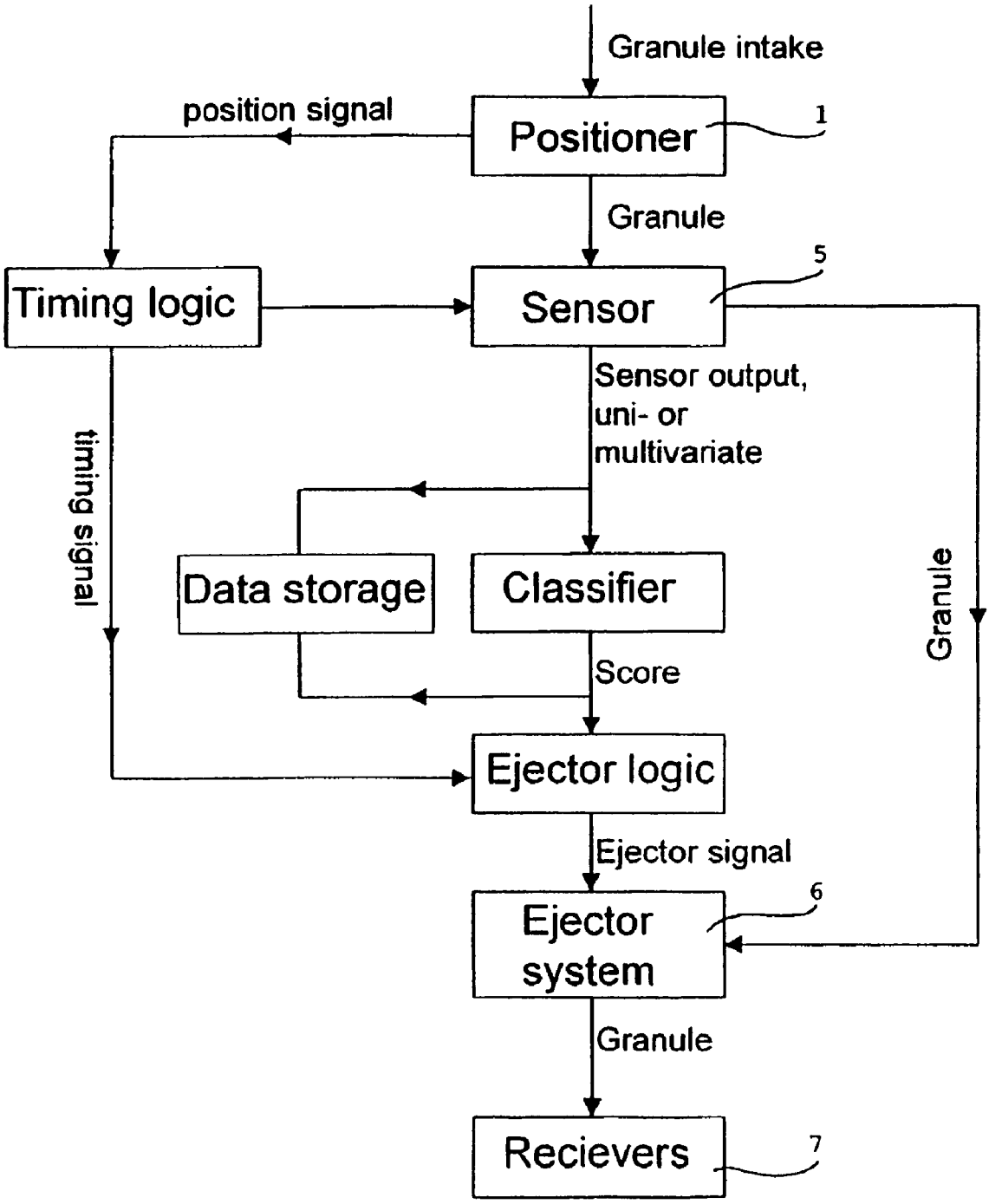
FIG. 8 is a block diagram of an alternative way to operate the sorting device.

In FIG. 8 a principal way to control the sorting device of the present invention according to one aspect is indicated in a block diagram. When the timer(s) or timing logic(s) detects a granule 9 in proper position, it activates the detecting means (sensor 5), with a time delay. The signal from the sensor 5 is processed in the classifier to establish into which receptacle 8 the granule 9 should be ejected. Then the ejector logic activates the appropriate ejecting means 6 at the right time, controlled by the timing logic. Thus, the granule 9 is fed into the receiving means 7 corresponding to the specific quality(ies) of the granule 9.

In another embodiment the recorded signal is a univariate signal that can be used directly as ejector signal. In a further embodiment the recorded signal is a number of univariate signals which by use of a simple equation can be converted into an ejector signal. As stated above an ejecting means 6 may be placed in close proximity to each detecting means, in which case the control of the ejecting means 6 is more simple. This set up is often used when the transparency of the granules 9 or the like is used to sort the granules 9.

The function of the apparatus may be described in the following way. The granules 9 are first fed into the cylinder 1, forming a "cushion" of granules 9 at the bottom of the cylinder 1. As the cylinder 1 is rotated the granules 9 will be picked up from the "cushion" and be received in the pockets 3, one granule 9 in each pocket 3. The form of the pockets 3 is adapted to an optimal capture and hold of the granules 9 in such a way that only one granule 9 is received in each pocket 3. Furthermore, the form of the pockets 3 in co-operation with the centrifugal and gravity forces make the granules 9 to be placed over the opening 4 of the pocket 3.

The proper and separate position of the granules 9 in the pockets 3 is used to secure a high precision detection and ejection, where only one granule 9 is ejected at the time, and where the granules 9 in the vicinity are not influenced, as the case in the free atmosphere falling in the colour sorter.

It could be said that the pockets 3 are used to position the granules 9 in proper or well-defined position for detection and ejection, or in other words in a proper position in view of the detecting and ejecting means. With the granule 9 in the bottom of the pocket 3, the quality of the granule 9 is detected by means of the detecting means. Depending on the quality detected the granule 9 is ejected into the proper receiving device 7, by means of the ejecting means 6. Via said receiving device 7 the granule 9 is transported to a receptacle 8 corresponding to the detected quality of the granule 9.

Depending on the form and type of granules 9 to be sorted a cylinder 1 having appropriate pockets 3 is chosen. The rest of the equipment may often be used after adaptation of the control software. Thus, the cylinder 1 is often the only part that has to be changed to perform a new sorting. It is also possible to arrange the pockets 3 on loose plates that are exchanged if needed. In other embodiments (not shown) the cylinder, concentric rings etc. is replaced by bands, belts, chain or rope arrangements, chutes etc. giving the objects a well-separated position. Thus, the term "positioning means" also covers the above. Sometimes also a counting device is arranged to count the number of sorted objects 9.

Furthermore, means are normally provided to "handle" dust and the like. Normally this is done in that the cylinder 1 is under a slight underpressure, while the detectors and energy sources may be flushed with filtered air. The ejecting air can depending on the set up of the ejectors, inside or outside the cylinder 1, be used to clean out possible dust left in the pockets or impurities, small pieces of broken granules and the like from the openings 4.

The invention claimed is:

1. A sorting device for sorting granules within a bulk of such granules, where the granules differ in quality, which sorting device comprises:

positioning means giving a well-separated position for each granule;

detecting means;

at least one source of electromagnetic radiation or sonic waves;

ejecting means and receiving means;

wherein the positioning means is a cylinder having a number of pockets placed in rows along the inner circumference of the cylinder so that, when the cylinder is rotated, the granules are positioned and held in the pockets for a time sufficient for detection and ejection wherein an opening is furnished in the bottom of each pocket, which opening is small enough not to the granules through, each pocket being adapted to capture and hold a granule and having a form in the area of the opening that facilitates positioning of the granule to fully cover the opening; and a timer to control the position of each pocket in relation to the detecting means and the ejecting means.

2. The sorting device of claim 1, wherein the granules are positioned and held in the pockets by means of centrifugal force at the top of the turn of the cylinder.

3. The sorting device of claim 2, wherein one detecting means is placed for co-operation with each row and that the detecting means contains one or more detectors for emitted, transmitted or reflected light or radiation or sonic waves, a CCD-camera, a diode array or a photocell and that the detecting means comprises at least one source of electromagnetic radiation or sound.

4. The sorting device of claim 3, wherein the source of electromagnetic radiation comprises at least one light emitting diode.

5. The sorting device of claim 3, wherein the detecting means is arranged for co-operation with several rows of pockets by means of fiber optic cables, filters or that a lens is placed at the end of each fiber optic cable.

6. The sorting device of any claim 1, wherein the ejecting means comprises at least one ejector placed in connection with each row of pockets and for co-operation with the detecting means and that a source of compressed air is connected to at least one ejector by means of one or more single way valves or multi way valves; wherein the ejecting means has a form of one flaps opening to the outside of a cylinder, at least two parts of the positioning means moving away from each other, and a rod.

7. The sorting device of claim 1, wherein at least one receiving means is placed to receive the granules being ejected by the ejecting means; that at least one receiving means is placed to receive the granules by means of gravity; or that the receiving means are troughs having a conveying mechanism at the bottom leading to a receptacle.

8. The sorting device of it claim 1, wherein the detecting means and ejecting means are connected to a micro controller unit, MCU.

9. The sorting device of claim 8, wherein an A/D converter is placed between each detecting means and the MCU and that the MCU includes at least a processor, an EEPROM and I/O units.

10. The sorting device of any claim 1, wherein each detecting means is placed in close proximity to an ejecting means.

11. A method for sorting granules into different fractions, the method comprising:

separating the granules in such a way that each single granule passes a detecting means in a well-separated and well-defined position;

synchronizing the position of each granule with a position of a detecting means and an ejecting means using a timer; and actively ejecting at least a subgroup of the granules into a receiving means in accordance with detected properties, wherein centrifugal forces are used in connection to positioning and holding of the granules in the well-separated and well-defined positions when passing the detecting and ejecting means.

12. The method of claim 11, wherein the granules are divided into two or more subgroups depending on detected qualities of each single granule.

* * * * *